US006572080B1

(12) United States Patent
Delikatzis

(10) Patent No.: US 6,572,080 B1
(45) Date of Patent: Jun. 3, 2003

(54) DUAL HYDRAULIC JACK SYSTEM

(76) Inventor: Chris A. Delikatzis, 12 Mouat St Eaglehawk, Bendigo, Victoria 3556 (AU)

( * ) Notice: Subject to any disclaimer, the term of this patent is extended or adjusted under 35 U.S.C. 154(b) by 0 days.

(21) Appl. No.: 09/881,883

(22) Filed: Jun. 15, 2001

(51) Int. Cl.[7] ..... B66F 3/24
(52) U.S. Cl. ..... 254/93 H; 254/89 H
(58) Field of Search ..... 259/93 H, 89 H, 259/93 HP, 93 R, 93 L, 9 B, 3 B; 91/508, 520, 535; 92/61–65

(56) References Cited

U.S. PATENT DOCUMENTS

| | | | | | |
|---|---|---|---|---|---|
| 2,434,296 | A | * | 1/1948 | Swanson | 254/93 H |
| 2,548,902 | A | * | 4/1951 | Mueller | 254/93 H |
| 2,614,536 | A | * | 10/1952 | Livers | 254/93 H |
| 3,959,970 | A | * | 6/1976 | Bos et al. | 254/93 H |
| 4,000,758 | A | * | 1/1977 | Meisenheimer, Jr. | 138/31 |
| 4,161,229 | A | | 7/1979 | Mifsud | |
| 4,293,012 | A | * | 10/1981 | Pierrat | 254/93 H |
| 4,506,867 | A | | 3/1985 | Leglue | |
| 4,616,807 | A | * | 10/1986 | Cheng | 254/93 H |
| 4,641,815 | A | * | 2/1987 | Yu | 254/93 H |
| 4,703,916 | A | * | 11/1987 | Hung | 254/93 H |
| D313,492 | S | | 1/1991 | Hung | |
| 5,186,094 | A | | 2/1993 | Allart | |
| 5,918,860 | A | | 7/1999 | Cho | |
| 5,975,496 | A | | 11/1999 | Hong et al. | |
| 6,073,886 | A | * | 6/2000 | Jakubowski, Jr. et al. | 244/137.4 |

* cited by examiner

*Primary Examiner*—Lee D. Wilson

(57) ABSTRACT

A dual hydraulic jack system for more quickly raising the jack up to a load to be lifted. The dual hydraulic jack system includes a dual pump assembly mounted a base. The dual pump assembly comprises an inner piston assembly movably positioned in a first fluid chamber and an outer piston assembly movably positioned in a second fluid chamber. A jack assembly is provided for lifting a load. The jack assembly includes a jack piston assembly movably positioned in a third fluid chamber. A first fluid channel is provided for fluid communication between the first, second and third fluid chambers. A second fluid channel is provided for fluid communication between a reservoir and the first and second fluid chambers. A first conduit is provided for fluid communication between the reservoir and the third fluid chamber. A plurality of valves is provided for controlling unidirectional flow of the fluid through the first and second fluid channels.

12 Claims, 7 Drawing Sheets

DUAL HYDRAULIC JACK SYSTEM

BACKGROUND OF THE INVENTION

1. Field of the Invention

The present invention relates to jacks and more particularly pertains to a new dual hydraulic jack system for more quickly raising the jack up to a load to be lifted.

2. Description of the Prior Art

The use of jacks is known in the prior art. More specifically, jacks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,161,229; U.S. Pat. No. 5,918,860; U.S. Pat. No. 5,975,496; U.S. Pat. No. 5,186,094; U.S. Pat. No. 4,506,867; and U.S. Pat. No. Des. 313,492.

While these devices fulfill their respective, particular objectives and requirements, the aforementioned patents do not disclose a new dual hydraulic jack system. The inventive device includes a base and a dual pump assembly mounted on a top of the base. The dual pump assembly comprises an inner piston assembly movably positioned in a first fluid chamber and an outer piston assembly movably positioned in a second fluid chamber. A jack assembly is provided for lifting a load. The jack assembly includes a jack piston assembly that is movably positioned in a third fluid chamber. A reservoir is provided for holding fluid in an interior of the reservoir. A first fluid channel is provided for providing fluid communication between the first, second and third fluid chambers. A second fluid channel is provided for providing fluid communication between the reservoir and the first and second fluid chambers. A first conduit is provided for providing fluid communication between the reservoir and the third fluid chamber. A plurality of valves is provided for controlling unidirectional flow of the fluid through the first and second fluid channels.

In these respects, the dual hydraulic jack system according to the present invention substantially departs from the conventional concepts and designs of the prior art, and in so doing provides an apparatus primarily developed for the purpose of more quickly raising the jack up to a load to be lifted.

SUMMARY OF THE INVENTION

In view of the foregoing disadvantages inherent in the known types of jacks now present in the prior art, the present invention provides a new dual hydraulic jack system construction wherein the same can be utilized for more quickly raising the jack up to a load to be lifted.

The general purpose of the present invention, which will be described subsequently in greater detail, is to provide a new dual hydraulic jack system apparatus and method which has many of the advantages of the jacks mentioned heretofore and many novel features that result in a new dual hydraulic jack system which is not anticipated, rendered obvious, suggested, or even implied by any of the prior art jacks, either alone or in any combination thereof.

To attain this, the present invention generally comprises a base and a dual pump assembly mounted on a top of the base. The dual pump assembly comprises an inner piston assembly movably positioned in a first fluid chamber and an outer piston assembly movably positioned in a second fluid chamber. A jack assembly is provided for lifting a load. The jack assembly includes a jack piston assembly that is movably positioned in a third fluid chamber. A reservoir is provided for holding fluid in an interior of the reservoir. A first fluid channel is provided for providing fluid communication between the first, second and third fluid chambers. A second fluid channel is provided for providing fluid communication between the reservoir and the first and second fluid chambers. A first conduit is provided for providing fluid communication between the reservoir and the third fluid chamber. A plurality of valves is provided for controlling unidirectional flow of the fluid through the first and second fluid channels.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dual hydraulic jack system apparatus and method which has many of the advantages of the jacks mentioned heretofore and many novel features that result in a new dual hydraulic jack system which is not anticipated, rendered obvious, suggested, or even implied by any of the prior art jacks, either alone or in any combination thereof.

It is another object of the present invention to provide a new dual hydraulic jack system which may be easily and efficiently manufactured and marketed.

It is a further object of the present invention to provide a new dual hydraulic jack system which is of a durable and reliable construction.

An even further object of the present invention is to provide a new dual hydraulic jack system which is susceptible of a low cost of manufacture with regard to both materials and labor, and which accordingly is then susceptible of low prices of sale to the consuming public, thereby making such dual hydraulic jack system economically available to the buying public.

Still yet another object of the present invention is to provide a new dual hydraulic jack system which provides in the apparatuses and methods of the prior art some of the advantages thereof, while simultaneously overcoming some of the disadvantages normally associated therewith.

Still another object of the present invention is to provide a new dual hydraulic jack system for more quickly raising the jack up to a load to be lifted.

Yet another object of the present invention is to provide a new dual hydraulic jack system which includes a base and a dual pump assembly mounted on a top of the base. The dual pump assembly comprises an inner piston assembly movably positioned in a first fluid chamber and an outer piston assembly movably positioned in a second fluid chamber. A jack assembly is provided for lifting a load. The jack assembly includes a jack piston assembly that is movably positioned in a third fluid chamber. A reservoir is provided for holding fluid in an interior of the reservoir. A first fluid channel is provided for providing fluid communication between the first, second and third fluid chambers. A second fluid channel is provided for providing fluid communication between the reservoir and the first and second fluid chambers. A first conduit is provided for providing fluid communication between the reservoir and the third fluid chamber. A plurality of valves is provided for controlling unidirectional flow of the fluid through the first and second fluid channels.

Still yet another object of the present invention is to provide a new dual hydraulic jack system that saves time for the user. The present invention utilizes a jacking system that uses both high and low pressure ratios to lift a load. The present invention uses dual pumps having a high-pressure ratio to more quickly move a jack assembly up to a load when there is little load pressure exerted on the jack assembly. Once pressure on the jack assembly increases one of the dual pumps stops delivering fluid to the jack assembly providing a lower pressure ratio causing the jack assembly to move less quickly thus more precisely.

Even still another object of the present invention is to provide a new dual hydraulic jack system that can reduce the potential of injury to a user due to repetitive arm or leg motions from operating a jack that has a single low-pressure ratio. Jacks having a single low-pressure ratio require a user to activate the jack relatively many more times to cover the same distance that the present invention can cover with less operation by the user. The less the user has to activate the jack the less susceptible the user will be to repetitive motion injury.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
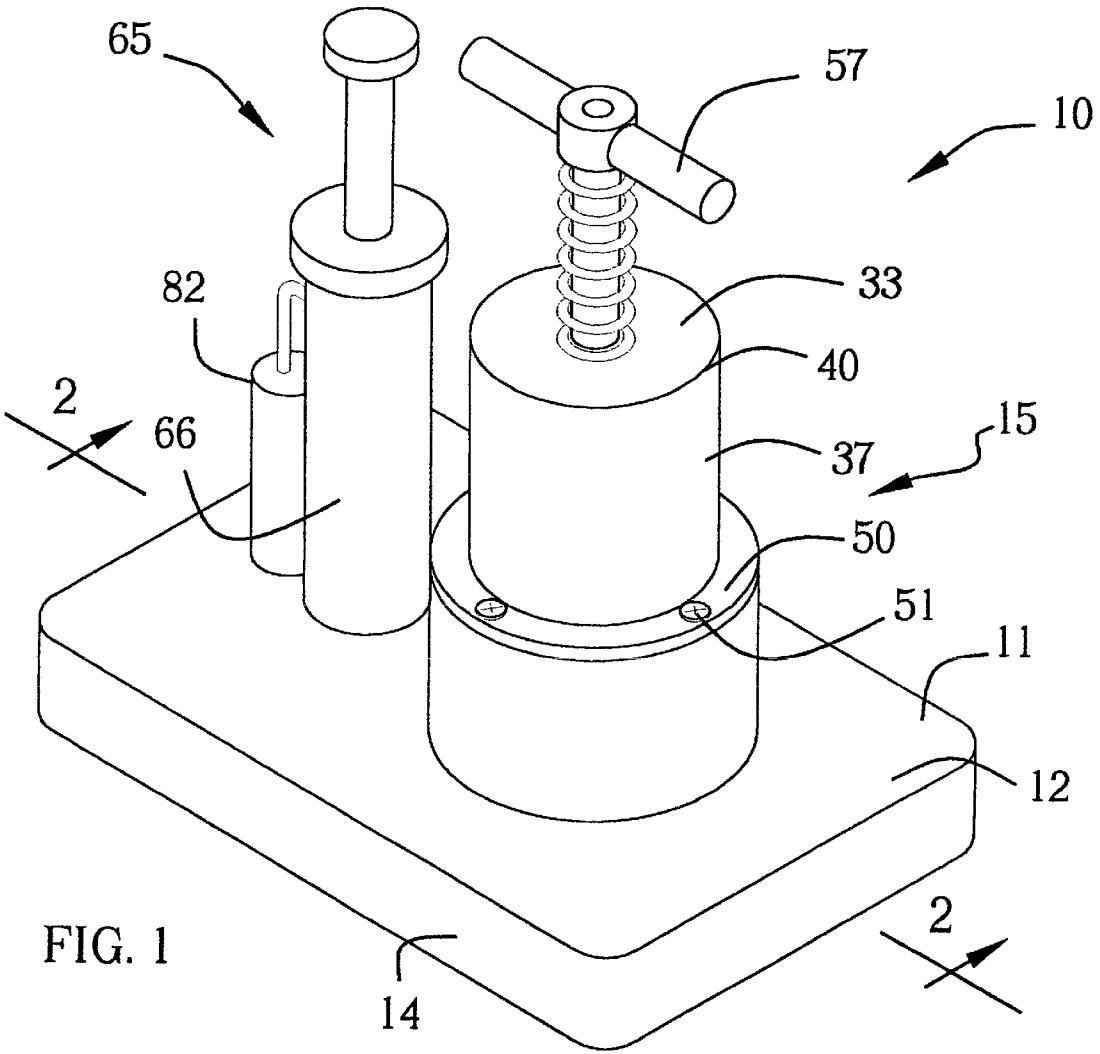
FIG. 1 is a schematic perspective view of a new dual hydraulic jack system according to the present invention.

With reference now to the drawings, and in particular to FIGS. 1 through 7 thereof, a new dual hydraulic jack system embodying the principles and concepts of the present invention and generally designated by the reference numeral 10 will be described.

Figure 2:
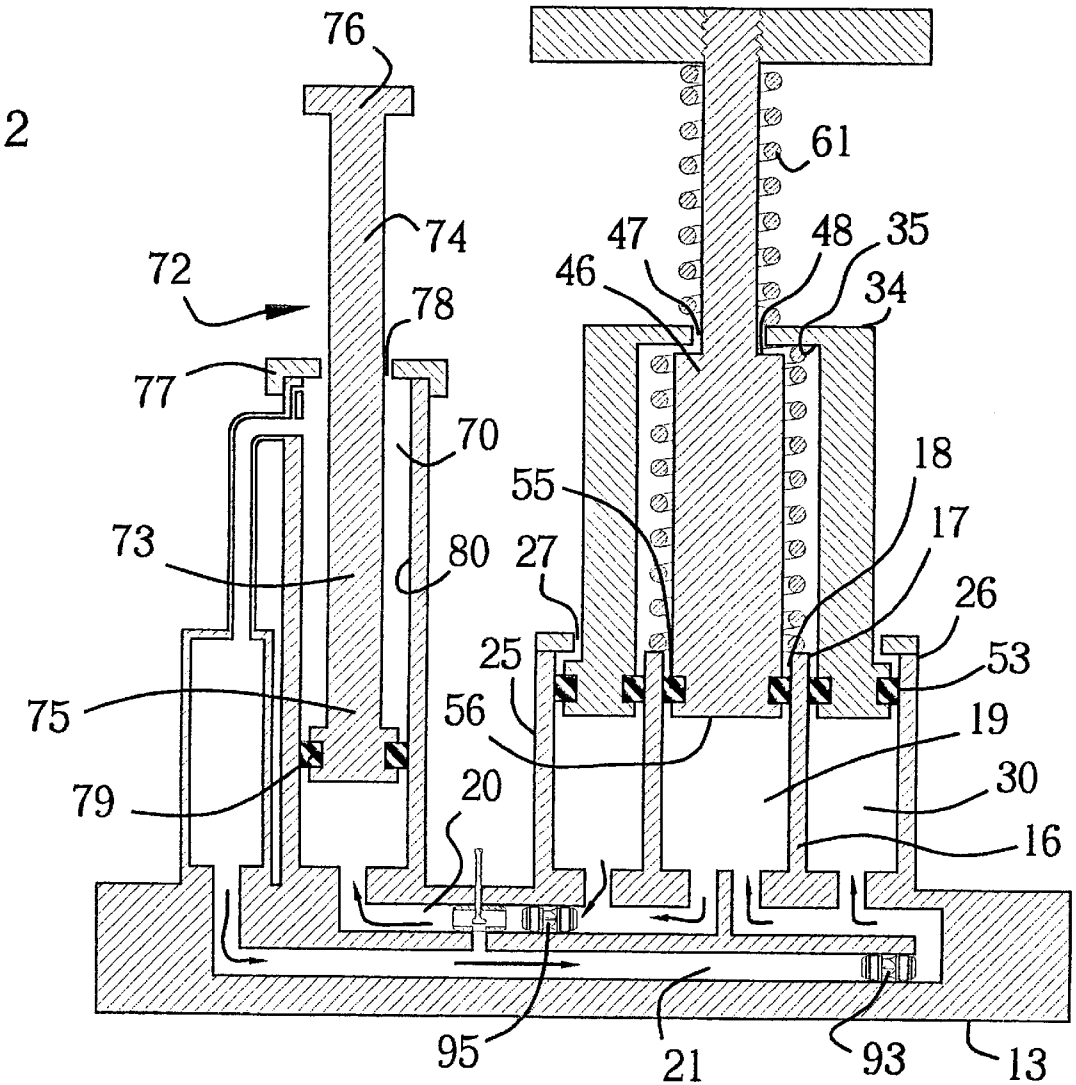
FIG. 2 is a schematic cross-sectional view of the present invention taken along line 2—2 of FIG. 1 showing a dual pump assembly in fluid communication with a jack assembly.
Figure 3:
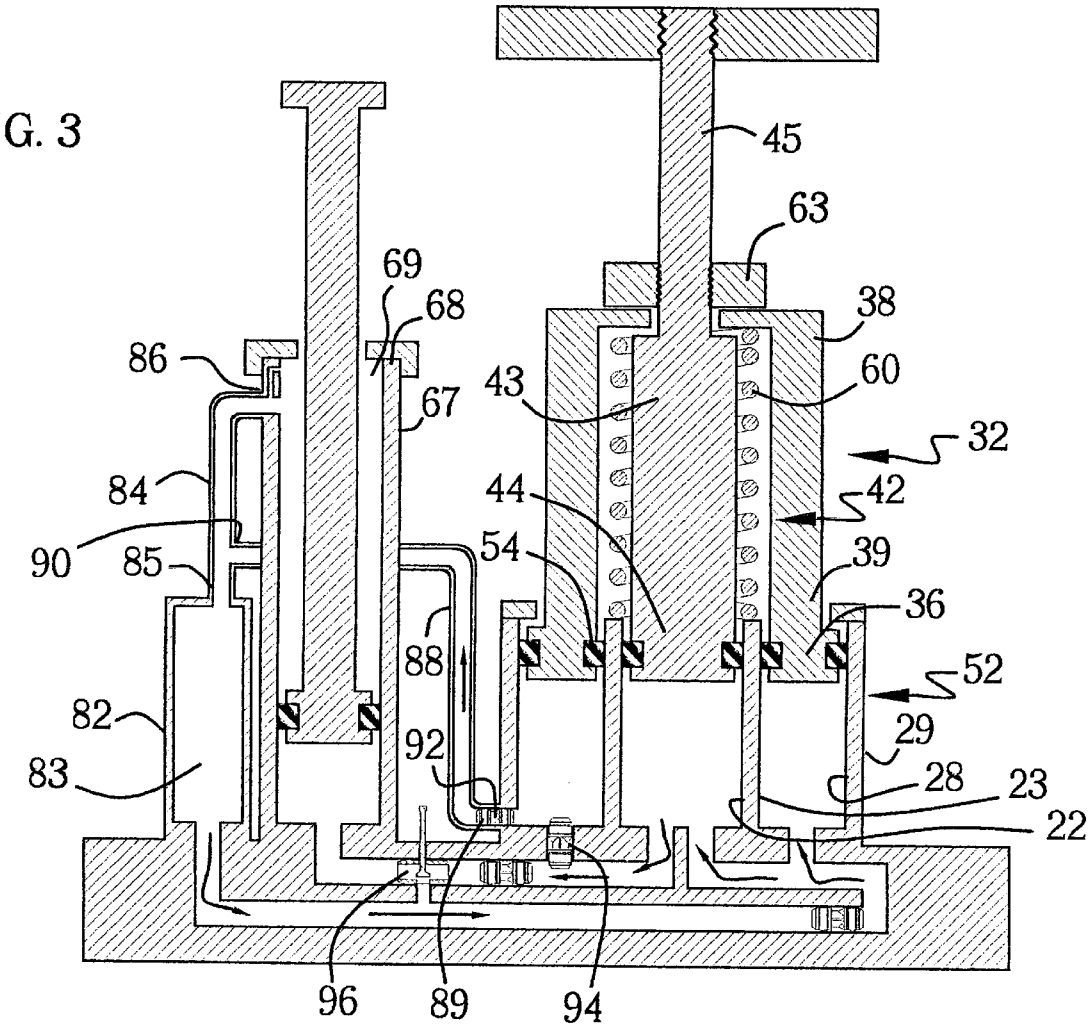
FIG. 3 is a schematic cross-sectional view of the present invention taken along line 2—2 of FIG. 1 showing a fluid chamber of the dual pump assembly in fluid communication with a reservoir.

As best illustrated in FIGS. 1 through 3, the dual hydraulic jack system 10 generally comprises a base 11, a dual pump assembly 15 and a jack assembly 65 for moving a load. The base 11 includes a top 12, a bottom 13 and plurality of lateral sides 14. The base 11 may comprise a substantially rigid material such as, for example, an iron or steel material.

As illustrated in FIG. 1, the dual pump assembly 15 is mounted on the top 12 of the base 11. As particularly illustrated in FIG. 2, comprises an inner wall 16 extending upwardly away from the top 12 of the base 11. The inner wall 16 includes an upper free edge 17 that defines an opening 18 extending into a first fluid chamber 19. The first fluid chamber 19 is in fluid communication with a first fluid channel 20 formed in the base 11. A second fluid channel 21 is also formed in the base 11 and is also in fluid communication with the first fluid chamber 19. As illustrated in FIG. 3, the inner wall 16 includes an inner cylindrical surface 22 and an outer cylindrical surface 23. The inner wall 16 may comprise a substantially rigid material such as, for example, an iron or a steel material.

As illustrated in FIGS. 2 and 3, an outer wall 25 extends upwardly away from the top 12 of the base 11. The outer wall 25 extends generally around the first cylinder 16. The outer wall 25 includes an upper edge 26 that defines an open top 27. The outer wall 25 includes an inner cylindrical surface 28 and an outer cylindrical surface 29. A space between the inner cylindrical surface 28 of the outer wall 28 and the outer cylindrical surface 23 of the inner wall 16 defines a second liquid chamber 30 of the dual pump assembly 15. The second fluid chamber 30 is in fluid communication with the first 20 and second 21 fluid channels in the base 11.

As illustrated in FIGS. 1,2 and 3, an outer piston assembly 32 is movably positioned in the second fluid chamber 30. The outer piston assembly preferably comprises an upper member 33 that includes an upper surface 34 and a lower surface 35. The upper member 33 is orientated generally parallel to the base 11 and is axially aligned with the second fluid chamber 30. As particularly illustrated in FIG. 2, an annular piston member 36 is mounted in the second fluid chamber 30 for movement in the second fluid chamber 30. A linking member 37 is provided for linking the upper member 33 to the annular piston member 36. The linking member 37 includes a first 38 and a second 39 opposed ends. The first end 38 is attached to a perimeter edge 40 of the upper member 33. The second end 39 of the linking member 37 is attached to an end of the annular piston member 36.

As illustrated in FIGS. 2 and 3, an inner piston assembly 42 is movably positioned in the first fluid chamber 19. The inner piston assembly 42 preferably comprises an inner piston member 43 that is mounted in the first fluid chamber 19 for movement in the first fluid chamber 19. The inner piston member 43 includes a lower piston portion 44 and an upper rod portion 45. In one embodiment of the present invention, the lower piston portion 44 is positioned in the first fluid chamber 19 and the upper rod portion 45 extends axially away from a first end 46 of the lower piston portion 44 extending through a hole 47 in the upper member 33. The upper rod portion 45 may include a diameter generally less than the lower piston portion 44 such that a shoulder 48 is formed thereon.

In one embodiment of the present invention, the outer piston assembly 32 is positionable between a first position and a second position. The first position is characterized by the annular piston member 36 being positioned generally adjacent to the upper edge 26 of the outer wall 25. The second position of the outer piston assembly 32 is characterized by the annular piston member 36 being positioned generally adjacent to the top 12 of the base 11. The shoulder 48 selectively abuts the upper member 33 when the inner piston member 43 is in an extended position.

As illustrated in FIG. 1, an annular stop ring 50 may be provided for limiting upward movement of the annular piston member 36. The stop ring 50 is coupled to and extends around-the upper edge 26 of the outer wall 25. The stop ring 50 is orientated generally parallel to the top 12 of the base 11. In one embodiment of the present invention, as particularly illustrated in FIGS. 2 and 3, the annular piston member 36 selectively abuts the stop ring 50 in the first position to prevent the annular piston member 36 from escaping from the second fluid chamber 30. The stop ring 50 may comprise a substantially rigid material such as, for example, an iron or a steel material. A plurality of fastening members 51 may be provided for removably fastening the stop ring 50 to the upper edge 26 of the outer wall 25. Each of the fastening members 51 may comprise a screw.

As illustrated in FIGS. 2 and 3, a plurality of gaskets 52 may be provided for resisting the fluid from escaping from the first 19 and second 30 fluid chambers. In one embodiment of the present invention, the plurality of gaskets 52 may comprise a first gasket 53 mounted about an outer surface of the annular piston member 36 and selectively abut the inner cylindrical surface 28 of the outer wall 25. A second gasket 54 may be mounted about an inner surface of the annular piston member 36 and selectively abut the outer cylindrical surface 23 of the inner wall 16. Additionally, a third gasket 55 may be mounted about an outer surface of the inner piston member 44 and positioned generally adjacent to a second end 56 of the inner piston member 44. The third gasket 55 selectively abuts the inner cylindrical surface 22 of the inner wall 16.

A handle 57 may be removably coupled to an end of the upper rod portion 45 for gripping by a hand of a user for moving the inner piston assembly 43 and the outer piston assembly 32 from the first position toward the second position. The handle 57 is preferably orientated generally parallel to the top 12 of the base 11. The handle 57 may be threadedly coupled to the upper rod portion 45 of the inner piston assembly 43. The handle 57 may comprise substantially rigid material such as, for example, a metal or a wood material.

As illustrated in FIGS. 2 and 3, a first biasing member 60 is provided for biasing the annular piston member 36 from the second position toward the first position. The first biasing member 60 is positioned between the lower surface 35 of the upper member 33 and the upper free edge 17 of the inner wall 16. The first biasing member 60 may comprise a coiled spring.

In one embodiment of the present invention, as particularly illustrated in FIG. 2, a second biasing member 61 may be provided for biasing the annular piston member 36 toward a position adjacent to the inner piston member 44. The second biasing member 61 is preferably positioned generally between the handle 57 and the upper surface 34 of the upper member 33. The second biasing member 61 preferably extends about the upper rod portion 45 of the inner piston assembly 43. The second biasing member 61 may comprise a coiled spring.

In one embodiment of the present invention, as particularly illustrated in FIG. 3, a securing member 63 may be provided for securing the annular piston member 36 in a position located generally adjacent to the inner piston member 44. The securing member 63 may be threadedly mounted on the upper rod portion 45 of the inner piston assembly 43. The securing member 63 is preferably positioned generally adjacent to the upper member 33. The securing member 63 may comprise a nut.

In the embodiment of the present invention having the first biasing member 60 and the second biasing member 61, both of the biasing members 60 and 61 bias the annular piston member 36 and the inner piston member 44 toward the first position. In the embodiment of the present invention having the first biasing member 60 and the securing member 63, the first biasing member 60 biases the inner piston member 36 and, since it is coupled to the inner piston member 36, the annular piston member 44 toward the first position.

The jack assembly 65 for lifting a load such as an automobile is mounted on the top 12 of the base 12. The jack assembly 65 preferably comprises a jack cylinder 66 that includes a cylindrical wall 67 extending upwardly from the top 12 of the base 11. An edge 68 of the cylindrical wall 67 of the jack cylinder 66 defines an opening 69 extending into a third fluid chamber 70. The third fluid chamber 70 is in fluid communication with the first fluid channel 20 in the base 11. The jack cylinder 66 may comprise a substantially rigid material such as, for example, an iron or a steel material.

As illustrated in FIGS. 2 and 3, a jack piston assembly 72 is movably positioned in the third fluid chamber 70. The jack piston assembly 72 preferably comprises a jack piston member 73 that is mounted in the third fluid chamber 70 for movement in the third fluid chamber 70. The jack piston member 73 includes a jack rod portion 74 and a jack piston portion 75. The jack piston portion 75 is movably positioned in the third fluid chamber 70. The jack rod portion 74 extends axially upward from a first end of the jack piston portion 75. The jack rod portion 74 may include a support plate portion 76 mounted on an end of the jack rod portion 74. The support plate portion 76 preferably lies in a plane generally parallel to the top 12 of the base 11.

In one embodiment of the present invention, the jack piston member 73 is positionable between a first position and a second position. The first position is characterized by the jack piston portion 75 being positioned generally adjacent to the edge 68 of the cylindrical wall 67. The second position of the jack piston member 73 is characterized by the jack piston portion 75 being positioned generally adjacent to the top 12 of the base 11.

A cover 77 may be removably coupled to an end of the jack cylinder 66. In one embodiment of the present invention, the jack rod portion 74 extends through a hole 78 in the cover 77. The jack piston portion 75 is selectively abutted against the cover 77 in the first position of the jack piston member 73.

As illustrated in FIGS. 2 and 3, a fourth gasket 79 may be provided for resisting the fluid from escaping from the third fluid chamber 70. The fourth gasket 79 is preferably mounted about an outer surface of the jack piston portion 75. The fourth gasket 79 selectively abuts an inner cylindrical surface 80 of the cylindrical wall 67 of the jack cylinder 66. The fourth gasket 79 may comprise a resiliently flexible material such as, for example, a plastic material resistant to fluids such as hydraulic fluid.

A reservoir 82 is provided for holding fluid such as hydraulic fluid in an interior 83 of the reservoir 82. The interior 83 of the reservoir 82 is in fluid communication with the second fluid channel 21 of the base 11. The reservoir 82 may comprise a substantially rigid material such as, for example an iron or a steel material.

As illustrated in FIGS. 2 and 3, a first conduit 84 is provided for providing fluid communication between the interior 83 of the reservoir 82 and the third fluid chamber 70. A first end 85 of the first conduit 84 is mounted to the reservoir 82 and a second end 86 of the first conduit 84 is mounted to the cylindrical wall 67 of the jack cylinder 66.

As particularly illustrated in FIG. 3, a second conduit 88 may be provided for providing a unidirectional fluid communication from the interior 83 of the reservoir 82 to the second fluid chamber 30. A first end 89 of the second conduit 88 is mounted to the outer wall 25 and a second end 90 of the second conduit 88 is mounted to a portion of the first conduit 84.

In an embodiment of the present invention utilizing the second conduit 88, a pressure valve 92 may be mounted in the second conduit 88 for regulating the pressure in the second fluid chamber 30. The pressure valve 92 includes a predetermined pressure setting whereupon when the pressure in the second fluid chamber 30 exceeds the pressure valve's 92 predetermined pressure setting fluid movement through the pressure valve 92 is permitted from the second fluid chamber 30 to the interior 83 of the reservoir 82.

A first valve 93 is provided for controlling fluid movement from the interior 83 of the reservoir 82 toward the first 19 and second 30 fluid chambers and for resisting fluid movement from the first 19 and second 30 fluid chambers toward the interior 83 of the reservoir 82. The first valve 93 is mounted in the second fluid channel 21 and positioned generally between the reservoir 82 and the first 19 and second 30 fluid chambers. The first valve 93 may comprise a unidirectional fluid valve.

A second valve 94 may be provided for controlling fluid movement from the second fluid chamber 30 toward the first fluid channel 20 and for resisting fluid movement from the first fluid channel 20 toward the second fluid chamber 30. The second valve 94 is mounted in the top 12 of the base 11 and position between the second fluid chamber 30 and the first fluid channel 20.

A third valve 95 is provided for controlling fluid movement from the first 19 and second 30 fluid chambers and the third fluid chamber 70 and for resisting fluid movement from the third fluid chamber 70 toward the first 19 and second 30 fluid chambers. The third valve 95 is mounted in the first fluid channel 20 and is positioned between the first 19 and second 30 fluid chambers and the third fluid chamber 70.

A release valve 96 is provided for controlling fluid movement through the first fluid channel 20. The release valve 96 is mounted in the first fluid channel 20 and extends outwardly through the top 12 of the base 11. The release valve 96 is position generally between the outer wall 25 and the cylindrical wall 67 of the jack cylinder 66. The release valve 96 operationally controls fluid communication between the first 19 and second 30 fluid chambers and the third fluid chamber 70. The release valve 96 may be opened to allow fluid communication between the first fluid channel 20 and the second fluid channel 21 in order to move the jack piston member 73 from the first position toward the second position.

Figure 4:
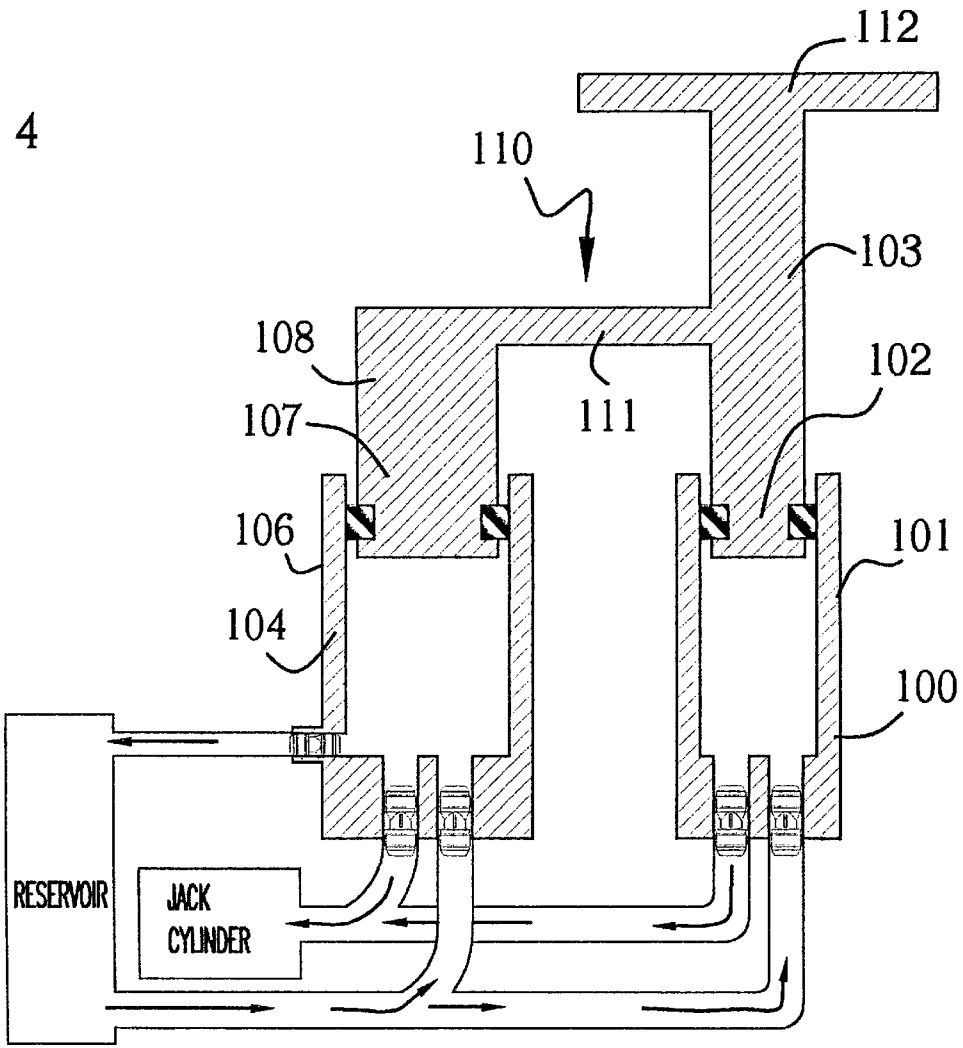
FIG. 4 is a schematic cross-sectional view of an optional embodiment of the present invention showing a dual pump assembly operationally coupled together by a linking member.
Figure 5:
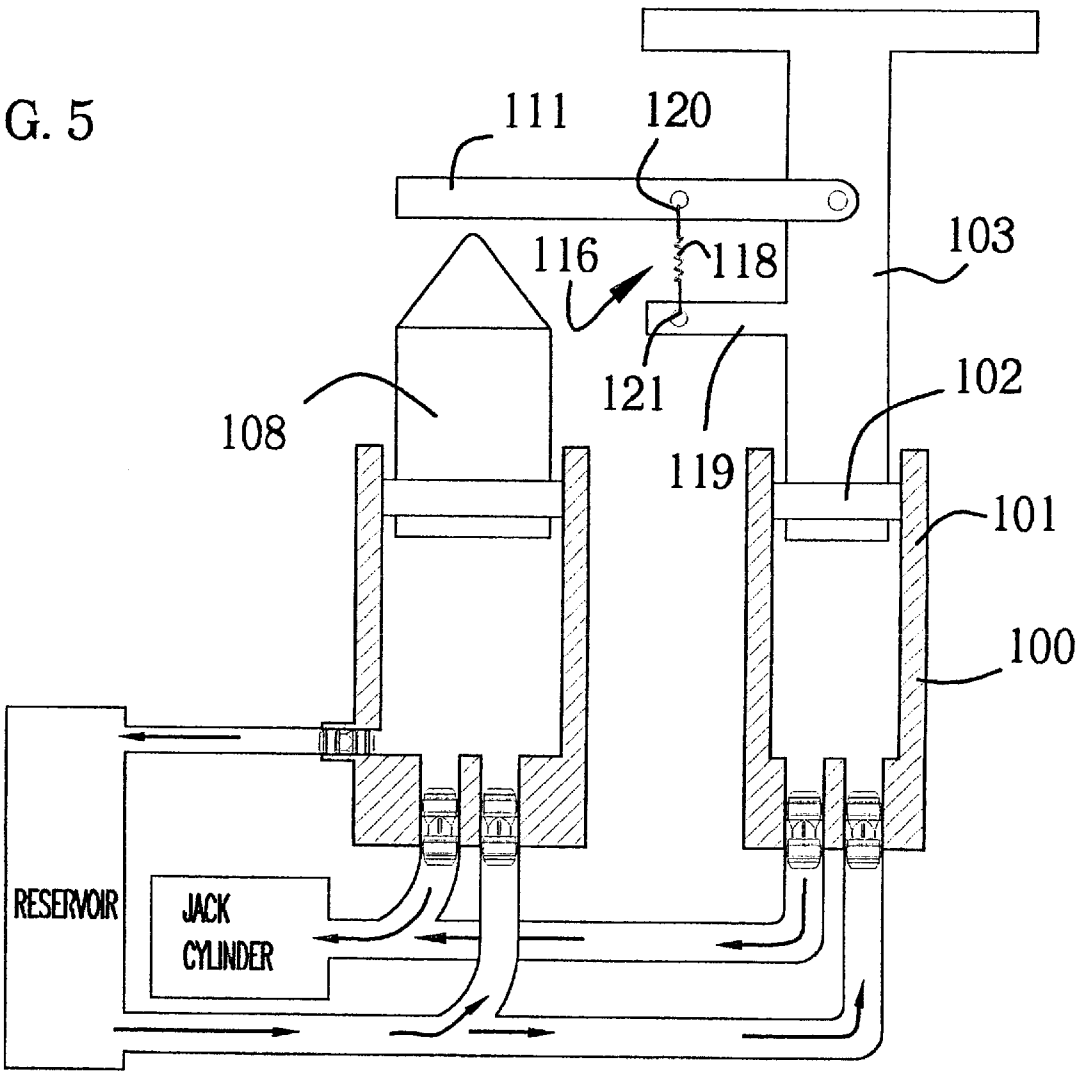
FIG. 5 is a schematic cross-sectional view of an optional embodiment of the present invention showing the dual pump assembly being operationally coupled by a biasing assembly.
Figure 6:
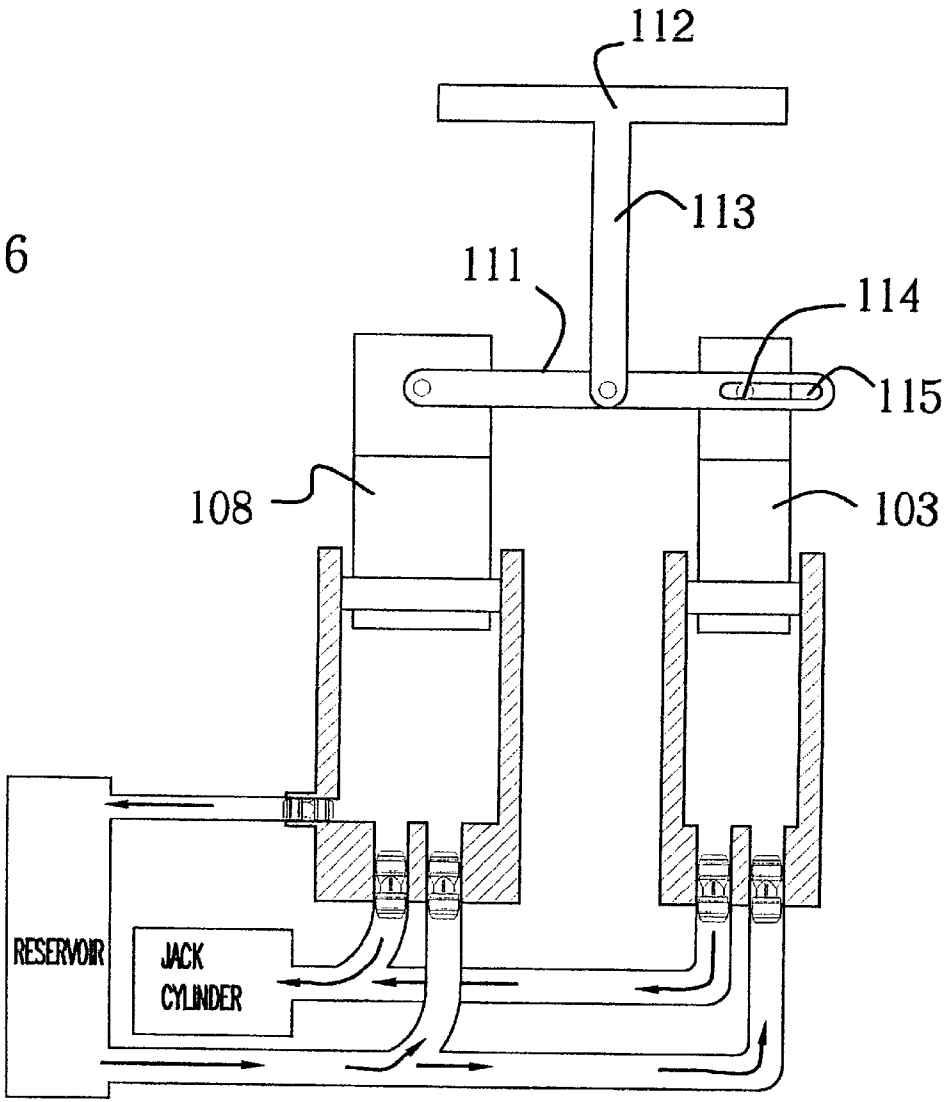
FIG. 6 is a schematic cross-sectional view of an optional embodiment the present invention showing the dual pump assembly being operationally coupled together by the linking member pivotally coupled to both pumps.

In optional embodiments of the present invention, as illustrated in FIGS. 4, 5 and 6, the dual pump assembly 15 is employed and comprises a primary pump mounted 100 on the base 11. The primary pump 100 preferably comprises a primary cylinder 101 and a primary piston 102 movable in the primary cylinder 100. A primary arm 103 is mounted on the primary piston 102 and extends out of the primary cylinder 101.

A secondary pump 104 is mounted on the base 11. The secondary pump 104 preferably comprises a secondary cylinder 106 and a secondary piston 107 that is movable in the secondary cylinder 106. A secondary arm 108 is preferably mounted on the secondary piston 107 and extends out of the secondary cylinder 106.

A linking assembly 110 is provided for linking the primary arm 103 of the primary pump 100 to the secondary arm 108 of the secondary pump 104. The linking assembly 110 transfers movement of the piston 102 of one of the pumps 100 to the piston 107 of the other of the pumps 104 in order to move the jack assembly 65.

In one embodiment of the present invention, as particularly illustrated in FIG. 4, the linking assembly 110 comprises a link member 111 rigidly mounted on the primary arm 103 of the primary pump 100 and on the secondary arm 108 of the secondary pump 104 such that the link member 111 is not pivotable with respect to the primary arm 103 and the secondary arm 108. A handle member 112 may be mounted on the primary arm 103.

In one embodiment of the present invention, as particularly illustrated in FIG. 6, the link member 111 may be pivotally connected to the primary arm 103 of the primary pump 100 and the secondary arm 108 of the secondary pump 104. The link member 111 is preferably elongate and pivotally mounted to the primary arm 103 at a pivot 114. The pivot 114 is movable along a longitudinal direction of the link member 111. A slot 115 may be formed in the link member 111 extending along the longitudinal direction of the link member 111. The pivot 114 is movable along the slot 115. The handle member 112 may be mounted on the link member 111 and may be pivotally mounted on the link member 111. The handle member 112 may have a substantially T-shape with a base end 113 of the T-shaped handle member 112 being mounted on the link member 111.

In one embodiment of the present invention, the link member 111 is pivotally mounted on the primary arm 103 of the primary pump 100. The link member 111 extends from the primary arm 103 over the secondary arm 108 such that movement of the primary arm 103 deeper into the primary cylinder 101 brings the link member 111 into contact with the secondary arm 108 for moving the secondary arm 108 and the secondary piston 107 deeper into the secondary cylinder 106. The linking assembly 110 includes a biasing assembly 116 for biasing the link member 111 toward the secondary arm 108. The biasing assembly 116 preferably includes a spring 118 mounted on the link member 111 and connected to the primary arm 103. The biasing assembly 116 preferably includes an extension arm 119 mounted on the primary arm 103 with a first end 120 of the spring 118 being mounted on the link member 111 and a second end 121 of the spring 118 being mounted on the extension arm 119. The handle member 112 is preferably mounted on the primary arm 103.

Figure 7:
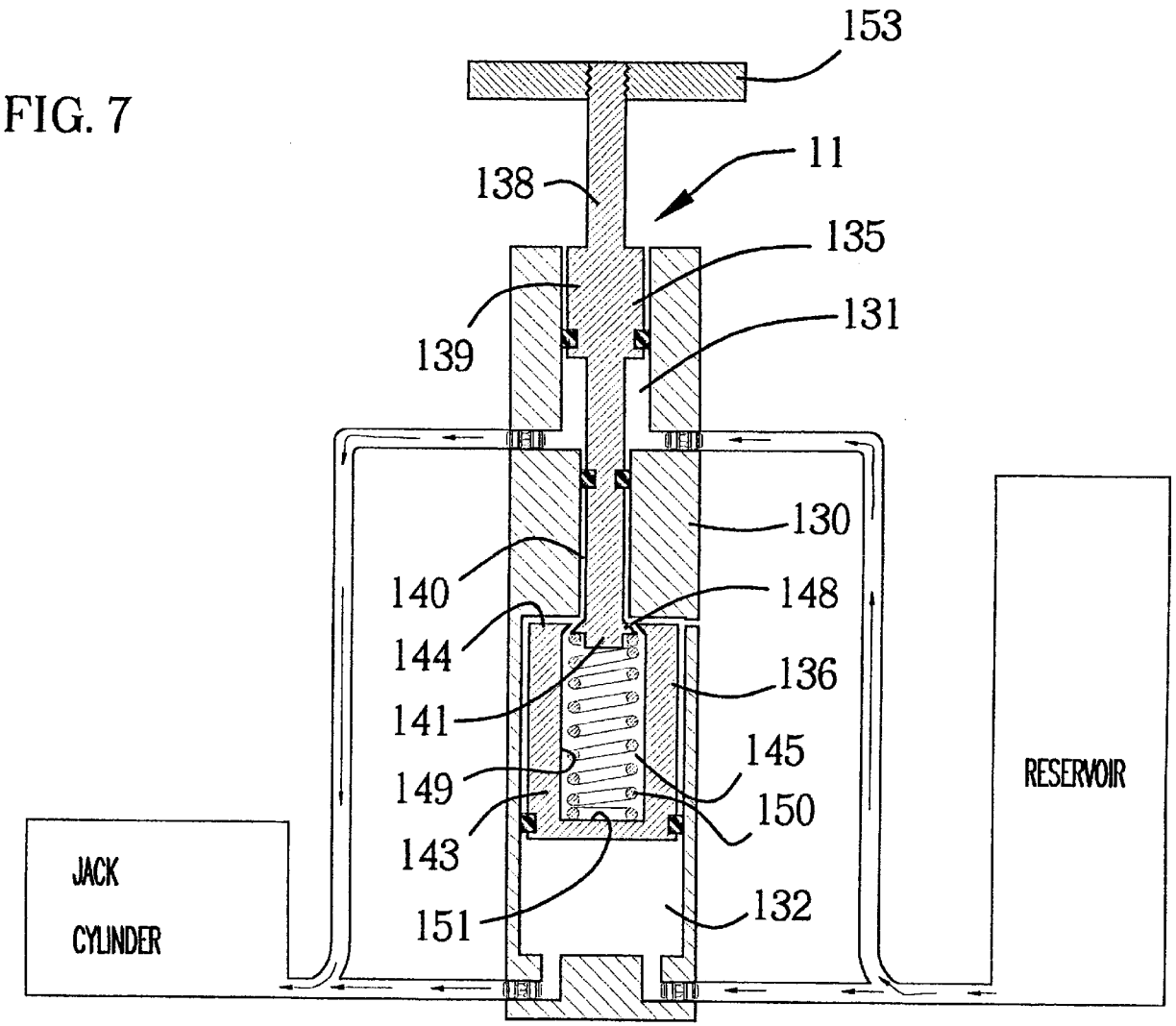
FIG. 7 is a schematic cross-sectional view of an optional embodiment of the present invention showing the dual pump assembly in a vertical orientation.

In yet another optional embodiment of the present invention, as illustrated in FIG. 7, the dual pump assembly 15 is employed and mounted on the base 11. A dual chamber cylinder 130 is formed on the base 11. The dual chamber cylinder 130 includes first fluid chamber 131 and a second fluid chamber 132. The first 131 and second 132 fluid chambers are in registration with each other. The dual pump assembly 15 may comprise an upper piston assembly 135 movably positioned in the first fluid chamber 131 in the dual chamber cylinder 130 and a lower piston assembly 136 movably positioned in the second fluid chamber 132 in the dual chamber cylinder 130.

In one embodiment of the present invention, the upper piston assembly 135 may include a rod 138 that has a first piston 139 formed thereon. The first piston 139 is movably positioned in the first fluid chamber 131. The dual chamber cylinder 130 preferably includes a channel 140 extending between the first 131 and second 132 fluid chambers. An end 141 of the rod 138 may extend through the channel 140 such that the end 141 of the rod 138 is movably positioned in the second fluid chamber 132.

The lower piston assembly 136 may include a second piston 143 movably positioned in the second fluid chamber 132. An end 144 of the second piston 143 may include a bore 145 extending therein. The end 141 of the rod 138 preferably extends into the bore 145 of the second piston 143. In one embodiment of the present invention, the rod 138 moves the first 139 and second 143 pistons.

In one embodiment of the present invention, the end 141 of the rod 138 is movably positioned in the bore 145. The end 141 of the rod 138 may include an annular flange 148 formed therein for selectively abutting an inner surface 149 of the bore 145. A biasing member 150 may be provided for biasing the end 141 of the rod 138 away from a bottom surface 151 of the bore 145. The biasing member 150 is preferably positioned between the annular flange 148 of the rod 138 and the bottom surface 151 of the bore 145.

A handle member 153 may be mounted on an end 155 of the rod 138. The handle member 153 may be threadedly coupled to the end 155 of the rod 138. The handle member 153 may have a generally T-shape. The handle member 153 may comprise a substantially rigid material such as, for example, a wood, plastic or metal material.

In one embodiment of the present invention, the dual chamber cylinder 130 may have a breather hole 156 extending into the second fluid chamber 132 to prevent a vacuum from occurring in the second fluid chamber 132 and hindering movement of the second piston 143.

In use, the first fluid chamber 19 and the second fluid chamber 30 work together to rapidly deliver fluid to the jack assembly 65 causing the jack piston member 73 to quickly rise from the first position toward the second position where it will encounter a load. Once the jack piston assembly 73 reaches the load the pressure in the second fluid chamber 30 builds until it reaches a predetermined pressure limit. Once the predetermined pressure limit is obtained the pressure release valve allows fluid to travel from the second fluid chamber 30 to the reservoir 82. After the predetermined pressure limit is obtained the pressure from the first fluid chamber 19 raises the load.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dual hydraulic jack system, said hydraulic jack system comprising:

a base having a top;

a dual pump assembly mounted on said top of said base, said dual pump assembly comprising:

an inner piston assembly movably positioned in a first fluid chamber;

an outer piston assembly movably positioned in a second fluid chamber;

a jack assembly for lifting a load, said jack assembly including a jack piston assembly being movably positioned in a third fluid chamber;

a reservoir for holding fluid in an interior of said reservoir;

a first fluid channel for providing fluid communication between said first and second fluid chambers and said third fluid chamber;

a second fluid channel for providing fluid communication between said reservoir and said first and second fluid chambers;

a first conduit providing fluid communication between said interior of said reservoir and said third fluid chamber;

a first valve mounted in a second channel for controlling fluid movement from said interior of said reservoir toward said first and second fluid chambers;

a third valve mounted in said first channel for controlling fluid movement from said first and second fluid chambers and said third fluid chamber; and a release valve mounted in said first fluid channel for controlling fluid movement through said first channel.

2. The dual hydraulic jack system of claim 1, wherein said dual pump assembly comprises:

an inner wall extending upwardly away from said top of said base, wherein an inner surface of said inner wall defines said first fluid chamber; and an outer wall extending upwardly away from said top of said base, said outer wall extending generally around said inner wall, wherein an upper edge of said outer wall defines an open top, said outer wall having an inner cylindrical surface and an outer cylindrical surface, wherein a space between said inner cylindrical surface of said outer wall and said outer cylindrical surface of said inner wall defines said second liquid chamber.

3. The dual hydraulic jack system of claim 2, wherein said outer piston assembly comprises:

an upper member being operationally coupled to said inner piston assembly;

an annular piston member mounted in said second fluid chamber for movement in said second fluid chamber;

a linking member for linking said upper member to said annular piston member.

4. The dual hydraulic jack system of claim 3, wherein said inner piston assembly comprises an inner piston member mounted in said first fluid chamber for movement in said first fluid chamber, said inner piston member having a lower piston portion positioned in said first fluid chamber, and a rod portion extending through a hole in said upper member of said outer piston assembly.

5. The dual hydraulic jack system of claim 4, additionally including a handle being removably coupled to an end of said upper rod portion of said inner piston member.

6. The dual hydraulic jack system of claim 4, additionally including:

a first biasing member for biasing said annular piston from a second position toward a first position, wherein said first position is characterized by said annular piston being positioned generally adjacent to said upper edge of said outer wall, wherein said second position of said outer piston is characterized by said annular piston member being positioned generally adjacent to said top of said base, first biasing member being positioned between said lower surface of said upper member and said upper free edge of said inner wall; and a second biasing member for biasing said annular piston member toward a position adjacent to said inner piston, said second biasing member being positioned between said handle and an upper surface of said upper member.

7. The dual hydraulic jack system of claim 4, additionally including a securing member for securing said annular piston member in a position located generally adjacent to said inner piston.

8. The dual hydraulic jack system of claim 1, wherein said jack assembly comprises a jack cylinder having a cylindrical wall extending upwardly from said top of said base to define said third fluid chamber.

9. The dual hydraulic jack system of claim 1, wherein said jack piston assembly has a jack rod portion and a jack piston portion, said jack piston portion being movably positioned in said third fluid chamber, said jack piston member having a support plate portion mounted on an end of said upper support portion.

10. The dual hydraulic jack system of claim 1, additionally including a second conduit providing a unidirectional fluid communication from said interior of said reservoir to said second fluid chamber, a first end of said second conduit being mounted to said outer wall, a second end of said second conduit being mounted to a portion of said first conduit.

11. The dual hydraulic jack system of claim 10, additionally including a pressure valve being mounted in said second conduit, said pressure valve having a predetermined pressure setting whereupon when pressure in said second fluid chamber exceeds predetermined pressure setting fluid movement through said pressure valve is permitted from said second fluid chamber to said interior of said reservoir.

12. A dual hydraulic jack system, said hydraulic jack system comprising:

a base having a top, a bottom and plurality of lateral sides, said base comprising a substantially rigid material;

a dual pump assembly being mounted on said top of said base, said dual pump assembly comprising:

an inner wall extending upwardly away from said top of said base, said inner wall having an upper free edge, said upper free edge of said inner wall defining an opening extending into a first fluid chamber, said first fluid chamber being in fluid communication with a first fluid channel formed in said base and a second fluid channel formed in said base, said inner wall having an inner cylindrical surface and an outer cylindrical surface;

an outer wall extending upwardly away from said top of said base, said outer wall extending generally around said first cylinder, said outer wall having an upper edge, said upper edge of said outer wall defining an open top, said outer wall having an inner cylindrical surface and an outer cylindrical surface, a distance between said inner cylindrical surface of said outer wall and said outer cylindrical surface of said inner wall defining a second liquid chamber of said dual pump assembly, said second fluid chamber being in fluid communication with said first and second fluid channels in said base;

an outer piston assembly, said outer piston assembly comprising:

an upper member having an upper surface and a lower surface, said upper member being orientated generally parallel to said base, said upper member being axially aligned with said second fluid chamber;

an annular piston member mounted in said second fluid chamber for movement in said second fluid chamber;

a linking member for linking said upper member to said annular piston member, said linking member having a first and a second opposed ends, said first end being attached to a perimeter edge of said upper member, said second end of said linking member being attached to an end of said annular piston member;

an inner piston assembly, said inner piston assembly comprising:

an inner piston member mounted in said first fluid chamber for movement in said first fluid chamber, said inner piston member having a lower piston portion and an upper rod portion, wherein said lower piston portion is positioned in said first fluid chamber, said upper rod portion extending axially away from a first end of said lower piston portion and extending through a hole in said upper member, said upper rod portion having a diameter generally less than said lower piston portion such that a shoulder is formed thereon;

wherein said outer piston assembly is positionable between a first position and a second position, wherein said first position is characterized by said annular piston member being positioned generally adjacent to said upper edge of said outer wall, wherein said second position of said outer piston is characterized by said annular piston member being positioned generally adjacent to said top of said base, said shoulder selectively abutting said outer wall when said inner piston member is in an extended position;

an annular stop ring for limiting upward movement of said annular piston member, said stop ring being coupled to and extending around said upper edge of said outer wall, said stop ring being orientated generally parallel to said top of said base, said stop ring, comprising a substantially rigid material, wherein said annular piston member selectively abuts said stop ring in said first position;

a plurality of fastening members for removably fastening said stop ring to said upper edge of said outer wall, said fastening member comprising a screw;

a plurality of gaskets for resisting said fluid from escaping from said first and second fluid chambers, wherein said plurality of gaskets comprising:

a first gasket mounted about an outer surface of said annular piston member, said first gasket selectively abutting said inner cylindrical surface of said outer wall;

a second gasket mounted about an inner surface of said annular piston member, said second gasket selectively abutting said outer cylindrical surface of said inner wall;

a third gasket mounted about an outer surface of said first inner piston, said third gasket being positioned generally adjacent to a second end of said inner piston, said third gasket selectively abutting said inner cylindrical surface of said inner wall;

a handle being removably coupled to an end of said upper rod portion, said handle being orientated generally parallel to said top of said base, said handle comprising substantially rigid material a first biasing member for biasing said annular piston member from said second position toward said first position, said first biasing member being positioned between said lower surface of said upper member and said upper free edge of said inner wall, said first biasing member comprising a coiled spring;

a second biasing member for biasing said outer piston toward a position adjacent to said inner piston, said second biasing member being positioned between said handle and said upper surface of said upper member, said second biasing member extending about said upper rod portion of said inner piston, said second biasing member comprising a coiled spring;

a securing member for securing said annular piston member in a position located generally adjacent to said inner piston, said securing member being threadedly mounted on a said upper rod portion of said inner piston, said securing member being positioned generally adjacent to said upper member, said securing member comprising a nut;

wherein said first biasing member and said second biasing member bias said annular piston member and said inner piston toward said first position;

a jack assembly for lifting a load, said jack assembly comprising:

a jack cylinder having a cylindrical wall extending upwardly from said top of said base, an edge of said cylindrical wall of said jack cylinder defining an opening extending into a third fluid chamber, said third fluid chamber being in fluid communication with a first channel in said base, said jack cylinder comprising a substantially rigid material;

a jack piston assembly, said jack piston assembly comprising:

a jack piston member mounted in said third fluid chamber for movement in said third fluid chamber, said jack piston member having a jack rod portion and a jack piston portion, said jack piston portion being movably positioned in said third fluid chamber, said jack rod portion extending axially upward from a first end of said jack piston portion, said jack piston member having a support plate portion mounted on an end of said upper support portion, said support plate portion lying in a plane generally parallel to said top of said base;

wherein said jack piston member is positionable between a first position and a second position, wherein said first position is characterized by said jack piston portion being positioned generally adjacent to said edge of said cylindrical wall, said second position of said jack piston member being characterized by said jack piston portion being positioned generally adjacent to said top of said base;

a cover being removably coupled to an end of said jack cylinder, wherein said jack rod portion extends through a hole in said cover, said jack piston portion being selectively abutted against said cover in said first position of said jack piston member;

a fourth gasket for resisting said fluid from escaping from said third fluid chamber, said gasket being mounted about an outer surface of said jack piston portion, said fourth gasket selectively abutting an inner cylindrical surface of said cylindrical wall of said jack cylinder, said fourth gasket comprising a resiliently flexible material;

a reservoir for holding fluid in an interior of said reservoir, said interior of said reservoir being in fluid communication with said second channel of said base, said reservoir comprising a substantially rigid material;

a first conduit providing fluid communication between said interior of said reservoir and said third fluid chamber, a first end of said first conduit being mounted to said reservoir, a second end of said first conduit being mounted to said cylindrical wall of said jack cylinder;

a second conduit providing a unidirectional fluid communication from said interior of said reservoir to said second fluid chamber, a first end of said second conduit being mounted to said outer wall, a second end of said second conduit being mounted to a portion of said first conduit;

a pressure valve being mounted in said second conduit, said pressure valve having a predetermined pressure setting whereupon when pressure in said second fluid chamber exceeds predetermined pressure setting fluid movement through said pressure valve is permitted from said second fluid chamber to said interior of said reservoir;

a first valve controlling fluid movement from said interior of said reservoir toward said first and second fluid chambers and resisting fluid movement from said first and second fluid chambers toward said interior of said reservoir, said first valve being mounted in said second channel and positioned generally between said reservoir and said first and second fluid chambers;

a second valve controlling fluid movement from said second fluid chamber toward said second channel and resisting fluid movement from said second channel toward said second fluid chamber, said second valve being mounted in said top of said base and position between said second fluid chamber and said second channel;

a third valve controlling fluid movement from said first and second fluid chambers and said third fluid chamber and resisting fluid movement from said third fluid chamber toward said first and second fluid chambers, said third valve being mounted in said first channel and positioned between said first and second fluid chambers and said third fluid chamber; and a release valve for controlling fluid movement through said first channel, said release valve being mounted in said first channel and extending outwardly through said top of said base, said release valve being position generally between said outer wall and said cylindrical wall, said release valve operationally controlling fluid communication between said first and second fluid chambers and said third fluid chamber.

* * * * *